US005596354A

United States Patent [19]

Murphy

[11] Patent Number: 5,596,354

[45] Date of Patent: Jan. 21, 1997

[54] INK PRIMING DEVICE FOR INK JET PRINTER

[75] Inventor: Charles F. Murphy, Milford, Conn.

[73] Assignee: Pitney Bowes Inc., Stamford, Conn.

[21] Appl. No.: 317,150

[22] Filed: Oct. 3, 1994

[51] Int. Cl.[6] ..... B41J 2/165

[52] U.S. Cl. ..... 347/30; 347/36

[58] Field of Search ..... 347/30, 29, 31, 347/36, 32, 87, 86

[56] References Cited

U.S. PATENT DOCUMENTS

| | | | |
|---|---|---|---|
| 4,042,937 | 8/1977 | Perry et al. | 346/1 |
| 4,577,203 | 3/1986 | Kawamura | 346/140 R |
| 4,586,058 | 4/1986 | Yamazaki et al. | 347/30 X |
| 4,641,154 | 2/1987 | Mikalsen | 346/140 R |
| 4,658,274 | 4/1987 | DeYoung | 346/140 R |
| 4,727,378 | 2/1988 | Le et al. | 346/1.1 |
| 5,055,856 | 10/1991 | Tomii et al. | 347/30 |
| 5,266,975 | 11/1993 | Mochizuki et al. | 346/140 R |
| 5,287,126 | 2/1994 | Quate | 346/140 R |
| 5,311,214 | 5/1994 | Hirasawa et al. | 346/1.1 |

*Primary Examiner*—John E. Barlow, Jr.

*Attorney, Agent, or Firm*—Steven J. Shapiro; Melvin J. Scolnick

[57] ABSTRACT

An ink priming device for an ink jet printing apparatus is disclosed which includes a housing adapted to fit over the nozzle plate of the print head when the print head is in a non-printing position, the housing having a substantially air tight connection to the nozzle plate. A vacuum generating pump having means defining a variable volume chamber is connected to the housing, and includes an actuator for sequentially decreasing and increasing the volume of the chamber to expel air to ambient atmosphere but not back to the housing and to draw air and ink pockets in the print head into the chamber as a result of the vacuum created when the volume of the chamber is increased, so that the print head is reprimed with ink to maintain proper operation

8 Claims, 3 Drawing Sheets

INK PRIMING DEVICE FOR INK JET PRINTER

BACKGROUND OF THE INVENTION

The present invention relates generally to the field of ink jet printing, and more particularly to an ink jet printer having means for priming the nozzles of the printer in the event that they become depraved and fail to operate on demand.

The technology of ink jet printing has become well known and printers of many sizes and configurations have become commonplace in various printing applications. This technology provides a relatively simple form of printing apparatus which yields rapid and substantially high quality print for the extent of printing apparatus complexity, and attendant cost, involved. These qualities render ink jet printing technology and apparatus based hereon highly suitable for a variety of printing applications, particularly computer deck top publishing, graphic plotters and textile printing, In order to better understand the problems which are solved by the present invention, it is necessary to have a basic familiarity with the principles of ink jet printing, and how the printer head works. Although there are several types of ink jet printers in general use, for the purpose of illustration the principles of ink jet printing will be explained in connection with the type of ink jet printer in which the present invention is intended for use, it being understood, however, that the present invention is applicable to any of the other types of ink jet printers. Generally speaking, ink jet printing involves he use of a print head having a matrix of very small nozzles arranged on a nozzle plate in very closely spaced relationship and spanning the distance over which a line of print, or other graphic representation, is to appear on paper. The print head includes a reservoir of ink which communicates through individual conduits with a plurality of very small chambers, one for each nozzle, through which the ink flows to reach the nozzles. Each chamber contains a small, high energy resistance heating element which is responsive to a minute electrical current to heat almost instantly to a sufficiently high temperature to volatilize the solvent in the ink and thereby create a small bubble in the ink adjacent the heating element. The momentary increase in pressure in the ink within the chamber resulting from creation of the bubble is sufficient to force a small amount of ink from the nozzle connected to the chamber and a tiny droplet of ink is deposited on the paper adjacent to the nozzle. The actual printing of any form of text or graphic material on a piece of paper is the result of extremely rapid control over the plurality of heating elements in a predetermined sequence under the control of suitable software and relative movement between the paper and the print head, to deposit droplets of ink in a pattern which will yield the desired image.

A significant problem that arises with this type of printing apparatus is that the nozzles may become deprimed from time to time, which means that a minute quantity of air gets into the nozzles adjacent the nozzle plate and prevents ink from being ejected therefrom in response to energization of the heaters during a printing operation. There are several factors which contribute to the possibility of the nozzles become deprimed, including ink solvent volatilizing in the nozzles adjacent the nozzle plate from lack of use of the printing apparatus for an extended period of time, some form of shock to the printing apparatus which breaks the air/ink interface and allows aid to enter the nozzles, printing a highly dense image, such as a picture or graphic, which tends to expel ink from the nozzles at a rate faster than that at which it can be replaced from the reservoir, resulting in a slight back pressure at the nozzle, thereby causing air to enter the chamber, and printing in a high ambient temperature environment which lowers the viscosity of the ink and thereby results in ink being expelled from the nozzles at the rate faster than that at which it can be replaced.

For whatever the reason, if the nozzles become deprimed, the print head will not operate properly, if at all, due to the lack of ink at the nozzles at the beginning of a printing operation. It is essential for proper operation of the print head that the air/ink interface remain precisely at the surface of the nozzles on the nozzle plate; if the air/ink interface breaks down for any reason and a minute amount of air becomes entrapped in the nozzles or in the ink conduits adjacent to the nozzles, the minute hydrostatic pressure built up in the heating chambers by the momentary energization of the heaters, and the correspondingly small bubble generated therein, is ineffective to force sufficient ink through the conduits and nozzles to reestablish a flow of ink to achieve printing. It then becomes necessary to reprime the nozzles, which is typically accomplished by effectively attaching a vacuum system to the print head to pull ink from the reservoir through the conduit/chamber system and out through the nozzles, thereby reestablishing the air/ink interface at the nozzle plate.

This problem has been addressed numerous times in the past and many different attempts to find a satisfactory solution can be found in the art. For the most part these solutions have involved a vacuum system built into the printing device which involved a relatively complex arrangement of a pump, a motor, tubing to communicate between the pump, the print head and a waste reservoir for excess ink pulled through the system. These arrangements generally were expensive, added an undesirable degree of complexity to the printing apparatus in which they were installed, thereby creating maintenance and packaging problems and wasted a considerable amount of ink over an extended period of time. Thus there is a need for a simple, inexpensive add easy to operate manual ink priming device which can be installed in existing ink jet printing devices with little or modification thereto, and which require little or no maintenance.

BRIEF SUMMARY OF THE INVENTION

The present invention substantially obviates in not entirely eliminates the shortcomings and disadvantages of prior art solutions to the problem of ink depriming in ink jet printers. As will be seen in more detail below, the present invention provides a manual depriming device which is relatively simple and inexpensive in design, can be built into most ink jet printing devices without substantial modification of the design thereof, is highly effective in operation without the need for complex pumps or motors, is extremely simple to operate and requires virtually no maintenance.

In its broadest aspects, the present invention is intended for use in an ink jet printing apparatus having a print head which includes a nozzle plate having an array of ink nozzles formed thereon, an ink reservoir, conduits communicating between the reservoir and the nozzles, and heaters disposed in the nozzles to create a bubble in the ink which generates sufficient hydrostatic pressure in the conduits to expel a minute quantity of ink from the nozzles upon energization of the heaters, the printing apparatus also having means for moving the print head from a home position across a piece of paper to cause the print head to deposit ink therein in an image pattern in response to selective energization of the heaters. In this environment, the present invention is an ink priming device for applying a vacuum to the nozzles and the conduits for pulling ink through the nozzles and conduits from the reservoir in the event that air enters the nozzles or the conduits, and comprises generally a housing adapted to fit over the nozzle plate of the print head when the print head is in its home position, the housing having means to engage the nozzle plate in a substantially air tight manner, the housing also having means defining an outlet aperture. There is a vacuum generating pump means defining a variable volume chamber for normally retaining a quantity of air, and a conduit is connected between the outlet aperture of the housing and the pump means. There is means permitting air to be expelled from the chamber to ambient atmosphere but not to the housing when the pump means reduces the volume of the chamber, and for permitting air to be withdrawn to the chamber from the housing but not from ambient atmosphere when the pump means increases the volume of the chamber. Finally, there is an actuating means for causing the pump means to sequentially decrease and increase the volume of the chamber, thereby sequentially expelling the air therefrom and creating a vacuum therein, whereby the vacuum generated by the action of the pump means pulls ink from the reservoir through the conduits and out of the nozzles to reprime the nozzles.

In some of its more limited aspects, the simplest form of means for permitting air to be expelled from and withdrawn back into the chamber includes a pair of one way valves disposed on opposite ends of the pump means, one of which communicates between the conduit and the interior of the chamber and the other communicates between the interior of the chamber and ambient atmosphere. The pump means preferably comprises a container defining the chamber which is formed of a resilient, shape retaining material which is capable of returning to its original shape after being distorted. The actuating means comprises an actuating arm which extends over the container and which has a bulbous portion which can be pressed into the container to deform it. As the arm is manually pressed downwardly, the resilient container is deformed, thereby reducing the volume of air within the chamber. Air is forced out of the chamber through the one way valve which communicates with ambient atmosphere, but is prevented from entering the conduit. When the arm is released, the container returns to its original shape, thereby drawing air in through the one way valve which communicates with the conduit.

In another embodiment, there is only a single one way valve on the pump means which communicates with ambient atmosphere and means for obstructing passage of air through the conduit means when the pump means is reducing the volume of the chamber The actuating means comprises a manually operable mechanism having a pair of movable elements which move in synchronism to cause the conduit means to be tightly pinched to obstruct the passage of air therethrough during the time that the flexible container is being distorted to reduce the volume of the chamber therein, and to remove the pinching effect on the conduit means during the time that the flexible container is returning to its original shape, so that air in the chamber is expelled only through the one way valve means when the resilient container is being distorted and is withdrawn back into the chamber only through the conduit means when the resilient container is returning to its original shape.

The present invention is useful not only for repriming an ink jet print head in the event that it should become deprimed for any of the reasons given above but also for reestablishing a proper flow of ink through the nozzles in the even that they become clogged with dried ink or with a minute particle of dust or other debris. Considering the almost microscopic size of the nozzle orifices, and therefore the relative ease with which they can become clogged by equally microscopic size dust particles, it is often possible to remove the dust particles, or perhaps particles of dried ink, by operating the priming device of the present invention to withdraw fresh ink from the print head and thereby restore full operation of all of the nozzles.

Having briefly described the general nature of the present invention, it is a principal object thereof the provide an ink priming device for an ink jet printer which will restore full normal operation to the print head of the ink jet printer if one or more nozzles thereof become deprimed.

It is another object of the present invention to provide an ink priming device for an ink jet printer which is effective to create a sufficient vacuum adjacent the nozzles of the print head to pull ink through the entire ink distribution system of the print head to expel air from the nozzles and adjacent conduits which is blocking the normal flow of ink.

It is yet another object of the present invention to provide an ink priming device for an ink jet printer which can be adapted for use with virtually every ink jet printer now available so as not to require any significant redesign for print head to accommodate the priming device of this invention.

It is still another object of the present invention to provide an ink priming device for an ink jet printer which is very simple in design and construction, is manually operated to avoid the complexity and cost of a powered vacuum system, is inexpensive to manufacture, and requires virtually no maintenance.

These and other object and advantages of the present invention will become more apparent from an understanding of the following detailed description of the presently preferred embodiments of the present invention when considered in conjunction with the accompanying drawings

DETAILED DESCRIPTION OF THE INVENTION

Figure 1:
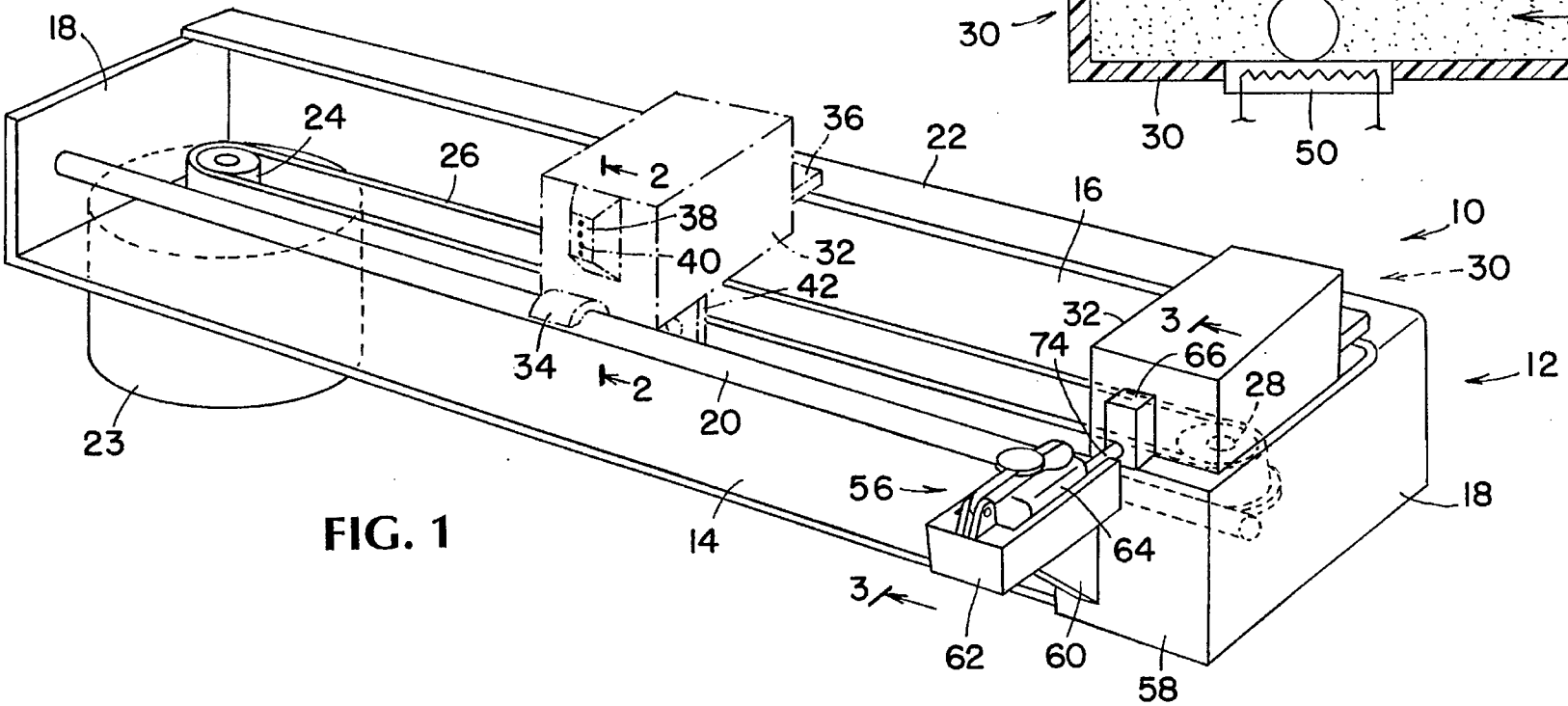
FIG. 1 is a longitudinal perspective of an ink jet print head transport mechanism which is part of an ink let printing apparatus which incorporates the present invention.

Referring now to the drawings, and particular to FIG. 1 thereof, there is seen a typical print head transport mechanism, designated generally by the reference numeral 10, that is used in an ink jet printer of the type briefly described above in the Background of the Invention section of this specification. It should be understood that ink jet printers of many types are well known in the art, and the principles of the present invention are applicable to all such printers, and therefore only so much structure of an ink jet printer is disclosed herein as is necessary to a full and complete understanding of the present invention.

The print head transport assembly 10 comprises generally a suitable elongate frame, indicated generally by the reference numeral 12, which is mounted in a printing apparatus such that it extends laterally across the width of the size of paper for which the printing apparatus is designed, for example, 8□ inches in the case of a typical desk top computer printer, and sufficiently far beyond on both sides to accommodate other operation components of the printing apparatus. The frame 12 includes a bottom wall 14, a rear wall 16 and end walls 18, and an elongate rod 20 which is fixedly mounted in the end walls 18. An upper wall or rail 22 is also disposed between the end walls 18.

A reversible motor 23 of known design and function is mounted on the underside of the bottom wall 14 adjacent one of the end walls 18, the motor 23 having a drive pulley 24 which drives an endless belt 26 which passes around another pulley 28 mounted on the bottom wall 14 adjacent the other end of the frame 12.

An ink jet print head, designated generally by the reference numeral 30, is mounted on the frame 12 and includes a body member or housing 32 which forms a reservoir for a supply of ink. The housing 32 includes a suitable bracket 34 which is appropriately shaped to ride along the bar 20 during movement of the print head 30 in the frame 12, and a suitable projection 36 which is adapted to ride on the upper wall or rail 22 during the same movement. The print head 30 also includes a nozzle plate 38 which includes an array of extremely small orifices or nozzles 40 through which ink is ejected onto a piece of paper disposed in substantial planar contact with the nozzle plate 38. The print head 30 is attached to one run of the drive belt 26 by a suitable bracket 42, so that when the motor 23 is actuated to drive the belt 26 in either direction, the print head 30 moves back and forth across the frame 12 from one side edge of the sheet of paper to the other.

From the foregoing description, considered with the brief explanation set forth above of the general construction and operation of an ink jet printer, it should now be apparent that when the motor 23 is sequentially operated in opposite directions, the print head is moved back and forth across the frame 12, and consequently across a sheet of paper, and droplets of ink are deposited on the paper as the print head 30 moves, the paper being indexed one or more lines at the end of each traverse of the print head along the frame 12.

Figure 2:
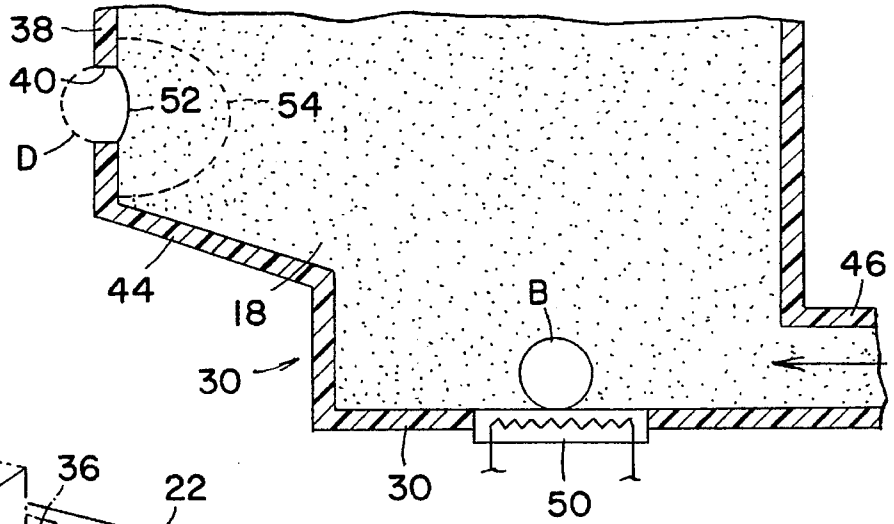
FIG. 2 is a sectional view, drawn to an enlarged scale, on the line 2—2 in FIG. 1 showing the manner in which an ink jet nozzle becomes deprimed.

As best seen in FIGS. 1 and 2, the nozzle plate 38 typically is disposed away from the body member 32 of the print head 30 by a suitable protrusion 44 which extends away from one wall of the body member 32, thereby providing suitable access to the nozzle plate 38 to a piece of paper without interference from the body member 32. It will be understood that the sheet of paper is held in place against the nozzle plate 38 by a suitable feeding mechanism which functions both to hold the sheet of paper firmly in a fixed position during printing and feeds it one increment of movement after the completion of a line of printing, all as is well known in ink jet printer technology and need not be further described for an understanding of the present invention. It will also be understood by those skilled in the art that the orifices or nozzles 40 are virtually microscopically small, typically being in the order of 50 microns or less in diameter and spaced approximately 3 mils apart. Thus, there are approximately 90 nozzles in the approximately _ inch length of the nozzle array, which produces a standard 360 DPI resolution. Therefore, it should be realized that the depiction of the nozzle 40 in FIG. 2 is greatly exaggerated for the purpose of illustrating the problem that is solved by the present invention.

That problem can now be explained in more detail than was set forth hereinabove with reference to FIG. 2. As previously mentioned, the print head includes a plurality of channels, one for each nozzle, which communicate between the nozzles and the ink supply, and each channel includes a chamber having a heating element which momentarily creates a bubble in the chamber which produces a minute but sufficient hydrostatic pressure to eject a very tiny droplet of ink from the nozzle to be deposited on paper held adjacent to the nozzle. Thus, as seen in FIG. 2, the print head 30 includes the channel 46 which communicates with a supply of ink stored elsewhere in the print head 30, and leads into a chamber 48 which in turn communicates directly with a nozzle 40, where the ink forms an ink/air interface 52 which normally is in the form of a meniscus just barely inside the nozzle orifice. A suitable extremely small, high energy resistance heater 50 is mounted on the body member 32 adjacent to the chamber 48 in position to create a small bubble B within the chamber which is of sufficient size to force a correspondingly small droplet of ink from the nozzle 40 and onto a piece of paper, as indicated by the droplet D. If for any reason, as discussed above, a minute quantity of air enters the chamber 48 adjacent to the nozzle, as indicated by the dotted line 54, the size of the bubble B generated by the heater 50 is insufficient to expel the quantity of air between the nozzle 40 and the line 54 to permit a droplet of ink to be expelled from the nozzle. The nozzle then ceases to function and, depending upon the number of nozzles adversely affected at the same time, the quality of the printed image deteriorates.

The ink priming device of the present invention, indicated generally in FIG. 1 by the reference numeral 56, is mounted on the frame 12 in any suitable manner adjacent one of the ends of the frame 12, usually the end opposite from that at which the drive motor 22 is located. In FIG. 1, the ink priming device 56 is mounted on a short front wall 58 by means of the bracket 60 so that the ink priming device 56 cannot move. In a typical installation, the location of the ink priming device 56 is beyond the farthest point of movement of the print head 30 during a printing operation, and therefore defines a "home" position for the print head when printing is not taking place, again as is well known in ink jet printer technology. It should be understood, however, that in some installations it may be desirable, due to space and/or packaging constraints, to have the ink priming device move relative to a stationary print head.

The ink priming device 56 comprises a suitable frame 62 supported by the bracket 60 in which a priming pump 64 is mounted. The priming device 56 also includes a cap 66 which is suitably connected to the frame 62. As best seen in any of FIGS. 3 through 8, the cap 66 has a rear wall 68 and a plurality of side walls 70 which together define a chamber 72 within the cap 66 which is open on the side opposite to the rear wall 68. It will also be seen that the side walls 70 have dimensions such that the opening defined by the side walls 70 has a configuration corresponding to the configuration of the nozzle plate 38 of the print head 30, with the result that when the print head 30 is in the aforementioned home position, the cap 66 completely encloses the nozzle plate 38 to isolate the nozzle plate 38 from ambient atmosphere. A suitable conduit 74 communicates between an outlet aperture 69 (see FIG. 3) in the rear wall 68 of the cap 66 and the main body member of the priming pump 64.

Figure 3:
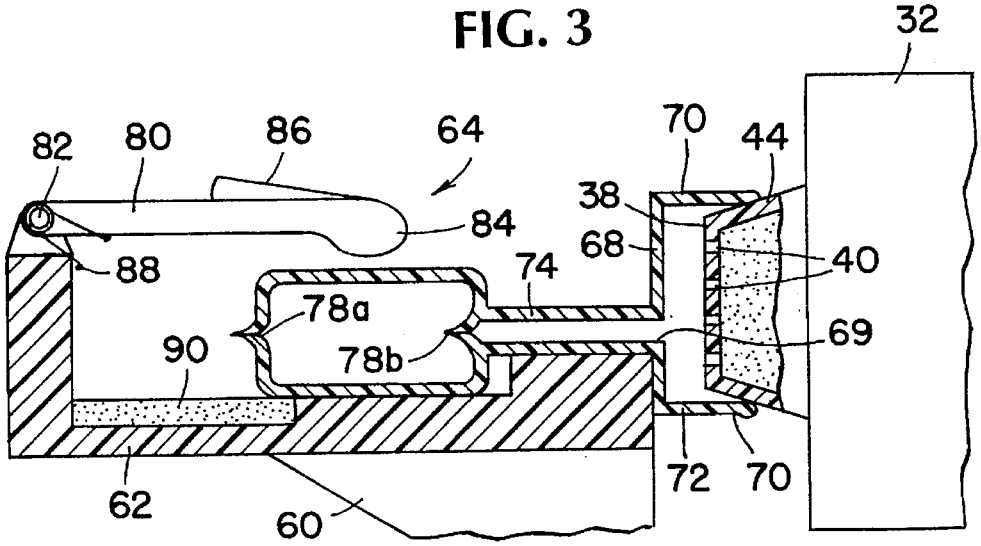
FIG. 3 is a sectional view, drawn to an enlarged scale, on the line 3—3 of FIG. 1 showing one embodiment of the ink priming device of the present invention.
Figure 4:
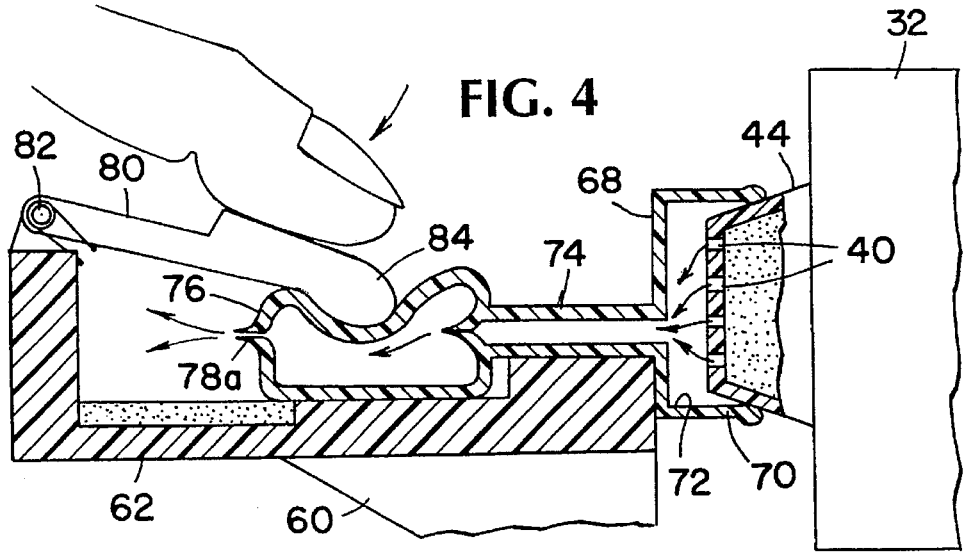
FIG. 4 is a view of the device shown in FIG. 3 but showing the pump element in its operating position.
Figure 5:
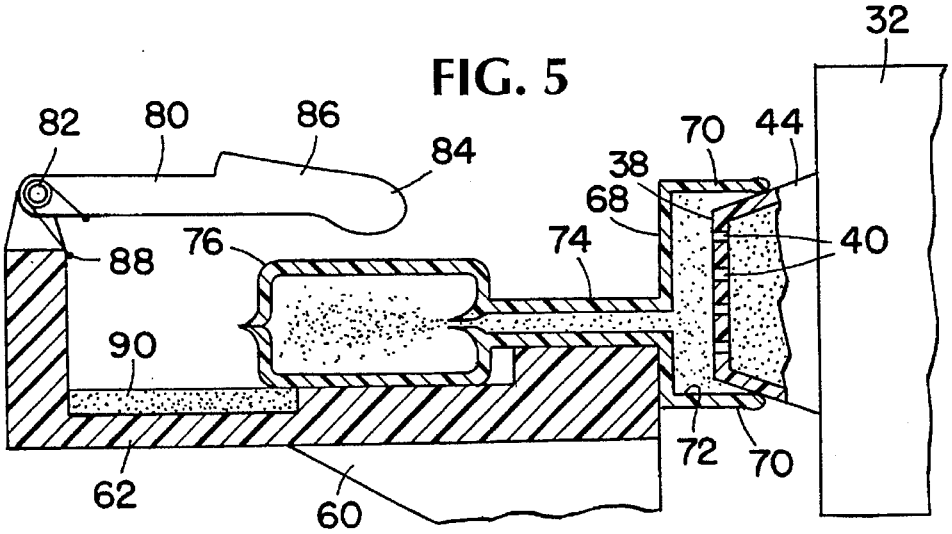
FIG. 5 is a view of the device shown in FIG. 3 but showing the pump element at the end of an operating cycle.

One embodiment of the invention is shown in FIGS. 3–5, in which the priming pump, now designated generally by the reference numeral 64, comprises a container 76 formed of any suitable resilient, shape retaining material, such as that used in common bulb syringes. The container 76 can have any suitable shape, but preferably it has an elongate configuration such that a pair of normally closed, one way valves 78, can be disposed at the opposite ends of the container such that both valves 78 permit the flow of air and ink in the same direction. An actuator for deforming the container 76 is mounted on the frame 62 and comprises an arm 80 pivotally connected as at 82 to an upper portion of the frame 62 having a bulbous portion 84 formed on the free end of the arm 80. An enlarged finger button 86 is formed on the upper side of the arm 80 to provide a convenient surface for pressing the arm downwardly by can operator's finger, as seen in FIG. 4. A suitable spring 88 which is mounted adjacent the pivot point 82 is deformed during downward movement of the arm 80 and returns the arm 80 to its normal position when the operator's fingers is removed. Finally, the frame 62 may include a replaceable absorbent pad 90 to collect ink which is withdrawn from the nozzles 40 and sucked through the pump 64.

The operation of the pump 64 is illustrated in FIGS. 4 and 5, in which it is seen that as the actuator arm 80 is moved downwardly by the operator's finger, the resilient container is deformed, thereby decreasing the volume of the container by expelling the air therein through the one way valve 78*a;* air is prevented from flowing through the conduit 74 into the cap 66 by the one way valve 78*b* which remains closed. When the operator's fingers is removed from the arm 80, it is returned to the position shown in FIGS. 3 and 5, but in so doing, the vacuum now created within the container by the resilient walls thereof returning to the normal, undistorted shape of the container, pulls ink through the channel 46 and chamber 48 of the print head and through the nozzles 40 to expel any air bubble and/or debris that may have gotten into any of the chamber 48. It should be understood that after several operations of the pump container 76, it will fill to a certain level with ink, which will be expelled together with some air on subsequent operations, and which dribbles from the valve 78*a* onto the absorbent pad 90, which is replaced from time to time as needed.

Figure 6:
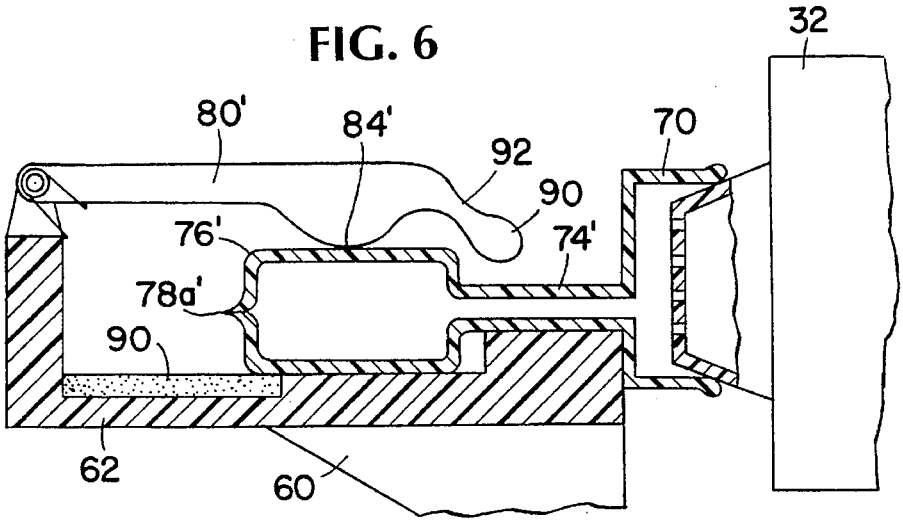
FIG. 6 is a view similar to FIG. 3 but showing another embodiment of the priming device of the present invention.
Figure 7:
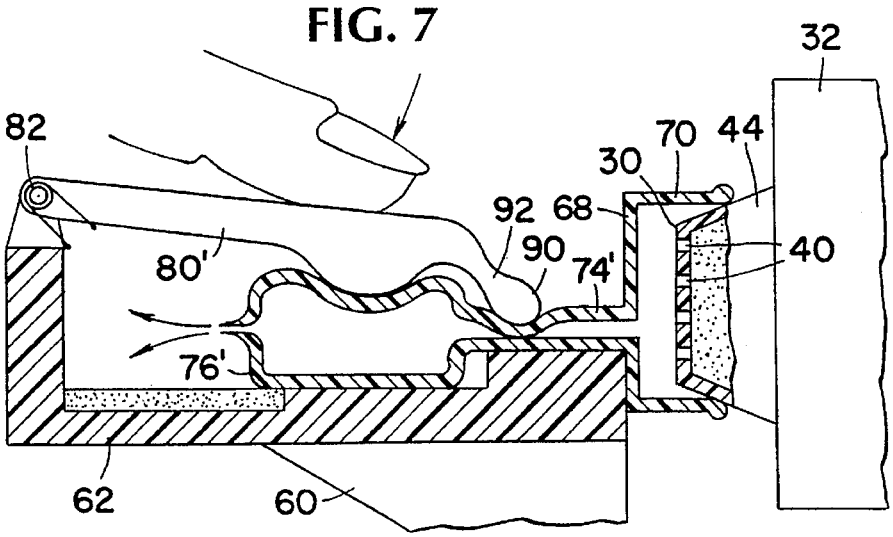
FIG. 7 is a view of the device shown in FIG. 6 but showing the pump element in its operating position.
Figure 8:
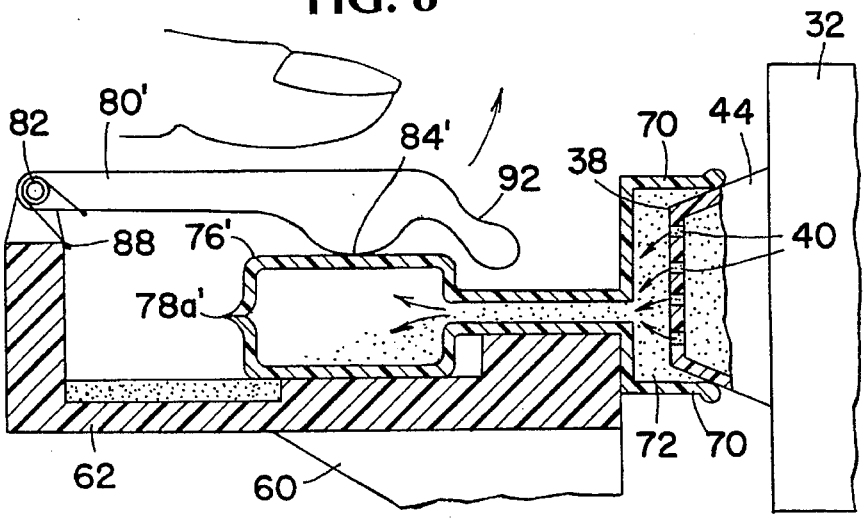
FIG. 8 is a view of the device shown in FIG. 6 but showing the pump element at the end of an operating cycle.

FIGS. 6–8 show an alternate embodiment of the pump 64 shown in FIGS. 3–5, in which all of the previous described parts are the same with the following exceptions. One is that the container 76' now has only a single one way valve 78*a'* which communicates between the inside of the container 76' and ambient atmosphere when it is open. Another exception is that the conduit 74' connecting the print head 32 to the container 76' is now formed of a resilient material, preferably the same material as that of the container 76', since these two parts can be molded together for convenience of manufacturing. The last exception is that the actuator arm 80' has a second bulbous portion 90 that is connected to the arm 80' by a relatively thin, flexible plastic hinge 92, located just beyond the bulbous portion 84', the arm 80', the bulbous portion 90 and the hinge 92 all being formed of a single piece of molded plastic. The plastic material selected for the part, as well as the dimensions of the hinge 92, are carefully selected such that the part has sufficient rigidity to exert sufficient force on the container 76' and the conduit 74' to distort them, but sufficient flexibility at the hinge 92 to permit relative movement between the actuator arm 80' and the second bulbous portion 84'. It will be noticed in FIG. 6 that the second bulbous portion 90 is substantially in contact with the upper surface of the conduit 74' while the bulbous portion 84' is spaced slightly above the upper surface of the container 76', so that the second bulbous portion 90 can deform the conduit 74' before the bulbous portion 84' deforms the container 76'.

In operation of this embodiment, the operator depresses the actuator arm 80' from the position shown in FIG. 6 to that shown in FIG. 7, during which the second bulbous portion 90 first contacts the flexible conduit 74' to deform it sufficiently to completely block the flow of air therethrough, as best seen in FIG. 7. Further downward movement of the actuator arm 80' causes the bulbous portion 84' to deform the container 76' to expel air through the one way valve 78*a'* while reducing the volume in the container 76', as shown in FIG. 7. When finger pressure on the actuator arm 80' is released, as shown in FIG. 8, the container 76' and the conduit 74' return to their original shape and a vacuum is created within the container 76', the conduit 74' and the adjacent chamber 48 and channels 46 in the print head 30, thereby drawing ink through the system to expel any air pockets in the chambers 48.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto. For example, while a bubble ink jet printing apparatus has been shown, the invention is equally applicable to a known piezo ink jet printing apparatus whereby a piezo electric material is electrically stimulated to change shape within the ink reservoir thereby forcing ink out of the nozzle. The piezo structure thus replaces the heating element bubble structure for creating the hydrostatic pressure required to force ink out of the nozzle.

I claim:

1. In an ink jet printing apparatus having a print head which includes a nozzle plate having an array of ink nozzles formed thereon, an ink reservoir, conduits communicating between the reservoir and the nozzles, an ink priming device for applying a vacuum to the nozzles and the conduits for pulling ink through the nozzles and conduits from the reservoir at times when air is present in the nozzles or the conduits, said ink priming device comprising:

A. a housing adapted to substantially surround the nozzle plate of the print head, said housing engaging said nozzle plate in a substantially air tight manner, said housing also having an outlet aperture;

B. a vacuum generating pump having a deformable shape retaining container defining a chamber therein, and actuating means for deforming said deformable shape retaining container from a normal shape to a deformed shape thereby reducing a volume of said chamber;

C. a conduit connected between said outlet aperture and said vacuum generating pump;

D. means for permitting air to be expelled from said chamber to ambient atmosphere but not into said housing at times when said actuating means deforms said deformable shape retaining container to said deformed shape to reduce the volume of said chamber and for withdrawing air into said chamber from within said housing but not from ambient atmosphere at times when said actuating means is released from deforming said deformable shape retaining container allowing said deformable shape retaining container to return to said normal shape to increase the volume of said chamber thereby drawing ink from the reservoir through the conduits and out of the nozzles.

2. An ink priming device as set forth in claim 1 wherein said means for permitting air to be expelled from and withdrawn into said chamber comprises A. a one way valve, disposed on said vacuum generating pump, which communicates said chamber with ambient atmosphere, and B. means for obstructing passage of air through said conduit when said vacuum generating pump reduces the volume of said chamber.

3. An ink priming device as set forth in claim 2 wherein said means for permitting air to be expelled from and withdrawn into said chamber further comprises a second one way valve, disposed on said vacuum generating pump, which communicates said chamber with said conduit, said second one way valve permitting the flow of air only from said conduit into said chamber.

4. An ink priming device as set forth in claim 3 wherein said actuating means comprises an arm mounted for movement toward and away from said deformable shape retaining container, said arm having a bulbous portion which is moveable into pressing contact with said deformable shape retaining container thereby deforming said deformable shape retaining container to said deformed shape.

5. An ink priming device as set forth in claim 2 wherein said actuating means comprises first movable means having a first bulbous portion operable on said deformable shape retaining container for deforming said deformable shape retaining container to said deformed shape, said deformable shape retaining container returning to said normal shape upon removal of said first movable means.

6. An ink priming device as set forth in claim 5 wherein

A. said conduit is formed of a resilient, shape retaining material, and

B. said means for obstructing passage of air through said conduit comprises second movable means, connected to said actuator means and having a second bulbous portion, for tightly pinching said conduit while said first movable means deforms said deformable shape retaining container, and for releasing said conduit from pinching said conduit when said first movable means is removed from deforming said deformable shape retaining container, whereby air in said chamber is expelled only through said one way valve when said first movable means deforms said deformable shape retaining container to said deformed shape and air is withdrawn back into said chamber only through said conduit when said first movable means is removed from deforming said deformable shape retaining container.

7. An ink priming device as set forth in claim 6 wherein said actuating means further comprises manually operable means for moving said first and second movable means in synchronism so that said second movable means tightly pinches said conduit means during the time that said first movable means deforms said deformable shape retaining container.

8. An ink priming device as set forth in claim 7 wherein said first and second movable means are normally disposed such that said second bulbous portion is in substantial contact with said conduit while said first bulbous portion is slightly spaced from said deformable shape retaining container, and said first and second movable means are connected by a flexible hinge which has sufficient rigidity to force said second bulbous portion to tightly pinch said conduit before said first bulbous portion deforms said deformable shape retaining container but sufficient flexibility to permit said first bulbous portion to deform said deformable shape retaining container after said second bulbous portion has tightly pinched said conduit.

* * * * *